US007181038B2

(12) United States Patent
Rivera et al.

(10) Patent No.: US 7,181,038 B2
(45) Date of Patent: Feb. 20, 2007

(54) ELECTRO-ACOUSTIC TRANSDUCER

(75) Inventors: Dean Menchaca Rivera, Chula Vista, CA (US); Christopher Sean Larson, San Diego, CA (US)

(73) Assignee: KSC Industries Incorporated, San Diego, CA (US)

( * ) Notice: Subject to any disclaimer, the term of this patent is extended or adjusted under 35 U.S.C. 154(b) by 360 days.

(21) Appl. No.: 10/798,529

(22) Filed: Mar. 10, 2004

(65) Prior Publication Data

US 2005/0201586 A1 Sep. 15, 2005

(51) Int. Cl.
*H04R 25/00* (2006.01)

(52) U.S. Cl. ..... 381/396; 381/430; 381/431

(58) Field of Classification Search ..... 381/396, 381/355, 182, 400, 423, 429, 430, 431, 406, 381/397, 162; 181/198, 199
See application file for complete search history.

(56) References Cited

U.S. PATENT DOCUMENTS 4,506,117 A 3/1985 Fresard
4,757,548 A 7/1988 Fenner, Jr.
RE32,785 E * 11/1988 Hirano ..... 381/413
5,335,284 A 8/1994 Lemons
5,473,700 A 12/1995 Fenner, Jr.
6,373,959 B1 * 4/2002 Masuda et al. ..... 381/417

* cited by examiner

*Primary Examiner*—Curtis Kuntz
*Assistant Examiner*—Tuan Duc Nguyen

(57) ABSTRACT

An electro-acoustic transducer for driving a large surface is used to convert electrical signals into sound. The transducer has a housing with a cast aluminum bottom and a molded plastic top. The top and bottom are fastened together by screws with a gasket in between the contacting surfaces to form a housing for a high power electromagnetic voice coil driver mechanism. The top has an opening to allow the voice coil to be centered in its gap by a centering gauge during assembly of the driver. A cap closes the opening once the voice coil is fixed in place in the housing. The op is hexagonal and flat with circular rings in the top surface to allow the top to flex in a controlled manner while supporting the bottom which remains stationary.

19 Claims, 3 Drawing Sheets

5
5
11
13
15
16
17
19
20
21
22
23
24
25
26
27
28
30
32
45
51
53
54

ELECTRO-ACOUSTIC TRANSDUCER

BACKGROUND OF THE INVENTION

1. Field of the Invention

The present invention relates generally to improvements in transducers and more particularly pertains to new and improved electroacoustic drivers wherein the transducer attaches to a large surface and in response to electrical signals cause that surface to move and create sound waves.

2. Description of Related Art

Those concerned with the development of electroacoustic transducers for driving large surfaces have continually been concerned with need for providing sufficient power to drive the large surfaces, removing the heat generated by units that have sufficient power to drive large surfaces, and creating an electroacoustic transducer that will produce a high quality sound. The present invention fulfills these needs.

SUMMARY OF THE INVENTION

The housing for the high power voice coil and driver mechanism of the transducer of the present invention is made of a rigid non-flexing bottom which supports a flat top designed to flex in a controlled manner as the result of its unique shape. A circular opening in the top allows the voice coil to be centered in its gap by a centering gauge during assembly of the driver mechanism. A cap closes the opening once the voice coil is fixed. The bottom of the housing is designed to remove large amounts of heat from the high power voice coil during operation.

BRIEF DESCRIPTION OF THE DRAWINGS

The exact nature of the present invention as well as its objects and advantages will become readily apparent upon consideration of the following detailed description in conjunction with the accompanying drawings in which like reference numerals designate like parts throughout the figures thereof and wherein.

DETAILED DESCRIPTION OF THE PREFERRED EMBODIMENTS

Figures 1, 2, 3:
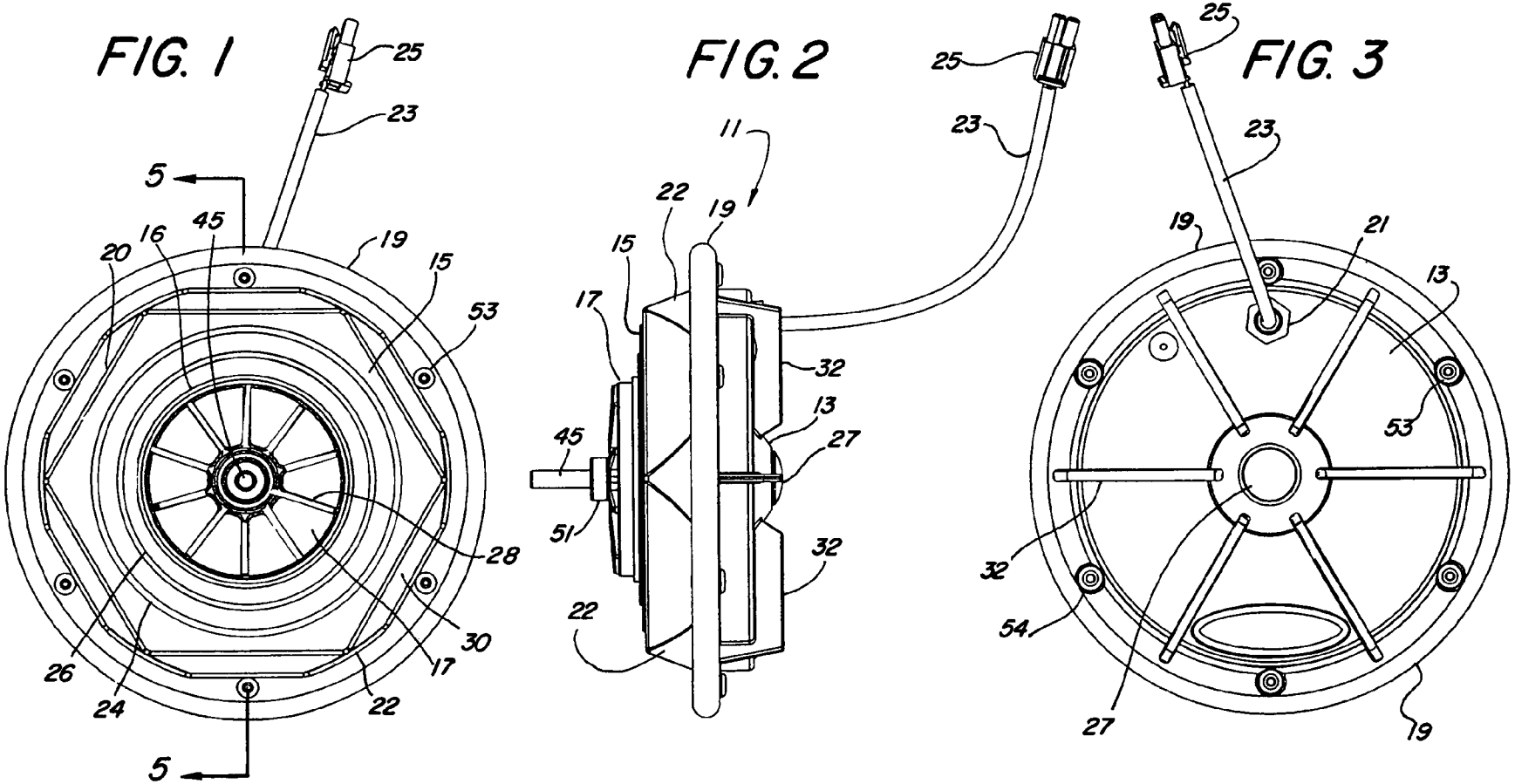
FIG. 1 is a top plan view of a preferred embodiment of the transducer of the present invention.
FIG. 2 is a side plan view of the transducer of the present invention.
FIG. 3 is a bottom plan view of the transducer of the present invention.

A preferred embodiment of the electroacoustic transducer 11 of the present invention, and specifically the novel features of the housing for the transducer of the present invention are illustrated in FIGS. 1, 2 and 3. The transducer 11 of the present invention is designed so that the top portion 15 (FIGS. 1 and 2) moves, and the bottom portion 13 (FIGS. 2 and 3) is rigid, and does not move. By allowing only the top portion to move, the transducer 11 behaves as a monopole transducer.

A dipole transducer, on the other hand, one where both the top and bottom surfaces are designed to move, is susceptible to destructive cancellation of energy. Destructive cancellation is an acoustic phenomenon that occurs when sound waves operate out of phase with each other. This can happen when both surfaces, top and bottom, move away from each other. Each surface cancels the energy produced by the other.

The transducer 11 of the present invention, by only allowing the top portion 15 of the transducer to move causes the overall energy radiated to be more efficient throughout the utilized band width. The bottom portion 13 is designed to be rigid and to efficiently dissipate heat generated by the transducer 11. For that reason the bottom portion 13 is preferably made from metal, such as cast aluminum, for example.

The top portion 15, on the other hand, is designed to flex and move in a controlled manner. The top portion 15 has a unique hexagonal shape with six equal sides 20 that extend from the flat top to the base at an angle 30. In addition to the sloping sides 30 for each of the six sides 20 of the hexagonally shaped top 15, a perpendicular surface area 22 extends from the apex of each of the sides 20 at the top to the base. This particular hexagonal top and side configuration has been found to provide exceptional support for the weight of the transducer 11, especially the weight contributed by the metal bottom portion 13. The entire weight is carried by the top portion 15 when the transducer is mounted vertically to a surface by a bolt 45, or similar fastener.

Figure 5:
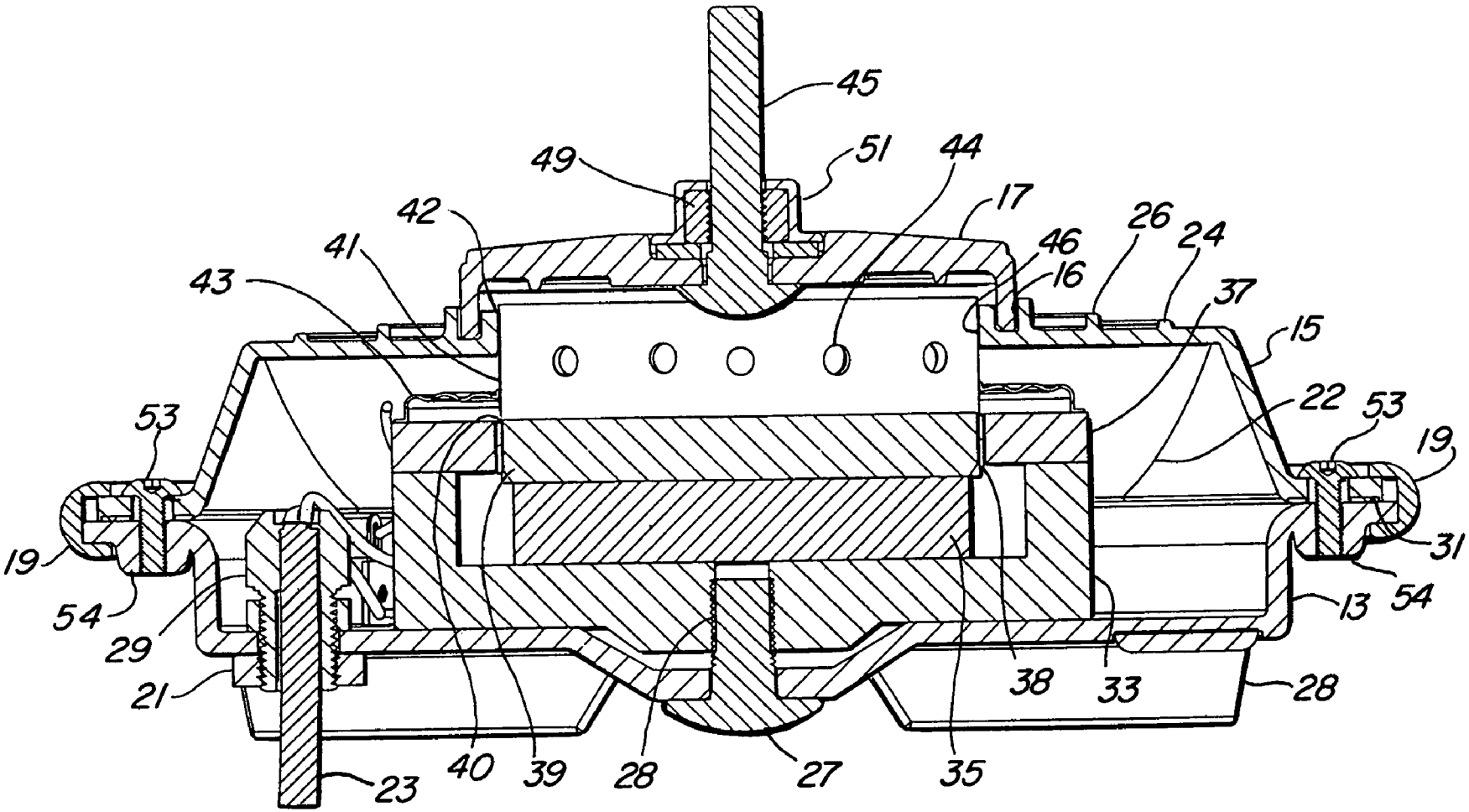
FIG. 5 is a cross-section taken along line 5—5 of FIG. 1 showing the internal parts of the transducer of the present invention in its assembled form.

The top portion 15 utilizes a plurality of circular rings 24, 26 which not only provide additional support for top portion 15, but also provide hinge points for top portion 15 to move. A circular cap 17 is mounted over an aperture 46 (FIG. 5) by being inserted into a circular groove 16 in top portion 15 (FIG. 5). The mounting bolt 45 extends out of cap 17 (see also FIG. 5). This bolt mounts the transducer 11 to a surface (not shown) to be driven by the transducer in a manner well known in the art. A plurality of support ribs 28 on cap 17 create additional rigidity and strength to the top portion 15 at the point where it mounts to the surface to be driven.

The material used for the top portion 15 is preferably a material that can be molded or machined into the desired shape. The flexible properties of the material used for the top portion are chosen on the basis of the application of the transducer. For example, if the transducer 11 is to produce primarily low frequencies such as desired for subwoofer application, the material for the top portion 15 could be a material that has high flexibility such as a thermal plastic rubber, for example.

The transducer of the present invention has been designed to achieve a high force factor. Force generated by the transducer 11 can be calculated from the formula:

$$f=bli$$

where: f=force b=flux density of the magnetic gap l=length of wire in magnetic gap i=current input into the transducer To achieve a high force factor, the product of flux density of the magnetic gap times the length of the wire in the magnetic gap must be high. Accordingly, the diameter of the coil was chosen to be large. A large diameter coil permits a long length of wire to be in the magnetic gap. In addition to the large diameter conductive coil, the height of the wire windings on the coil is greater by using a thicker top plate that is 8 millimeters thick, for example. In addition to these features, to provide a high force factor, it is preferred that a neodymium magnetic material is used. This material has a very high magnetic strength and thereby provides a high flux density in the magnetic gap of the coil.

The high power capability of transducer 11 requires that the resulting heat generated in the conductive coil be transferred to the surrounding metal parts. Adjusting the winding height of the voice coil to the height of the top plate and blackening all the metal parts helps to wick the heat from the voice coil to the surrounding metal parts. To increase heat dissipation, the outside portion 13 of the housing for transducer 11 is powder coated in black and has a plurality of cooling fins 32 extending radially from the center along the outside of the bottom portion 13. Moreover, the voice coil 41 is designed with vent holes 44 (FIGS. 4 and 5) to allow heat to flow away from the voice coil area out to the cooler metal or the plastic parts, and especially the aluminum bottom portion 13 and the magnetic metal assembly surrounding the voice coil 42 (FIG. 5). It is also preferred that the material used for the voice coil is a material designed to handle high temperature and function to isolate the heat generated by the voice coil to the area of the voice coil. Materials such as Kapton or TIL (fiberglass) which are well known in the industry are well suited for this purpose. Other materials may also be used, such as aluminum, for example, for lower temperature applications which provide different acoustical damping characteristics.

Figure 4:
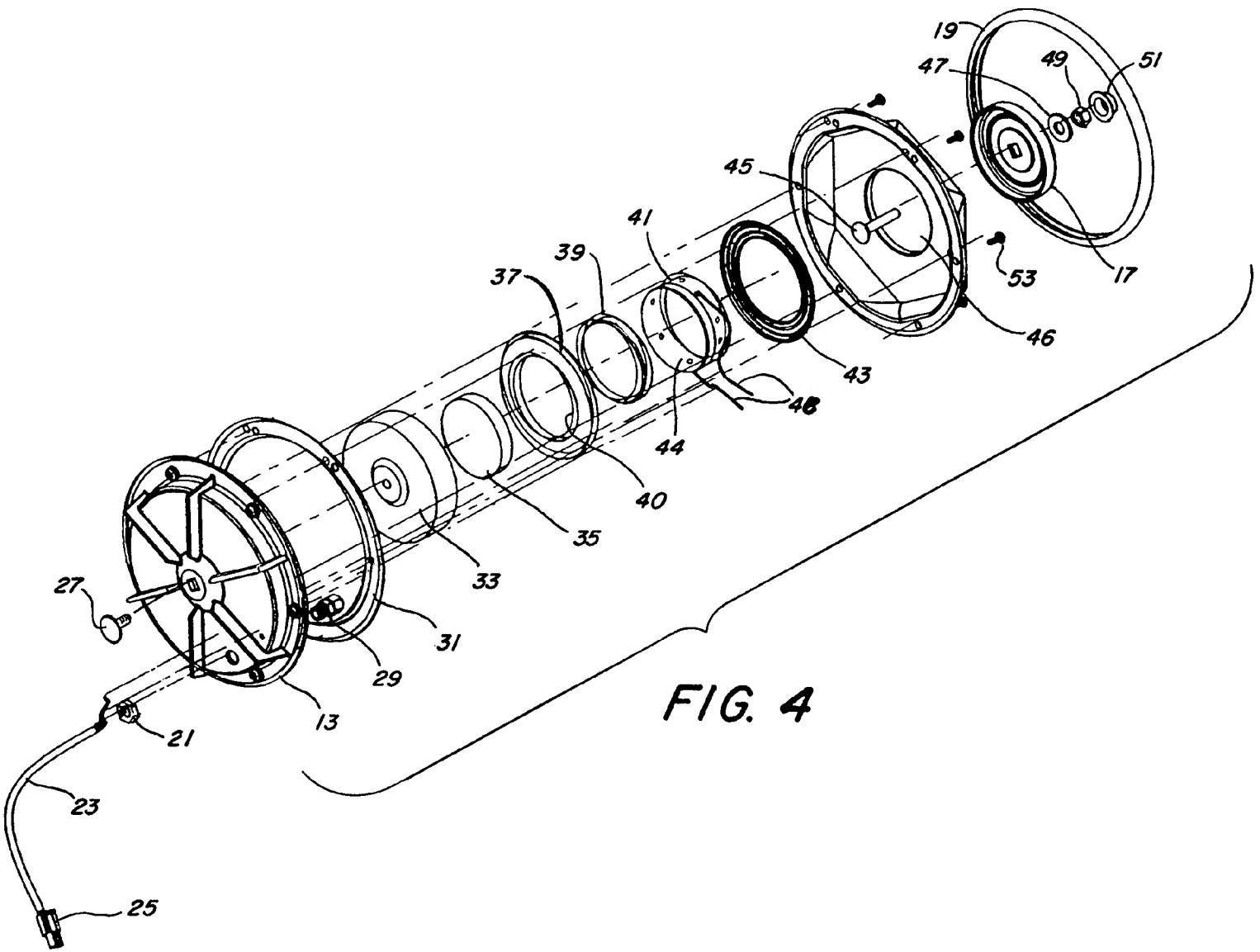
FIG. 4 is an exploded view showing the parts of the transducer of the present invention.

Referring now to FIGS. 4 and 5, the preferred structure for the transducer 11 of the present invention including all of its component parts is illustrated. The bottom portion 13 and the top portion 15 of the transducer housing are fastened together along their circumferential periphery to enclose the operative parts of the transducer as illustrated in FIGS. 4 and 5. A plurality of screws 53 pass through apertures in top portion 15 and thread into threaded apertures in bottom portion 13. A gasket 31 is placed between the two connecting parts of top portion 15 and bottom portion 13. The gasket functions to prevent buzzing noises between the two covers and is also a seal that prevents moisture from entering the housing of the transducer.

A bottom plate 33 fastens to the inside of metal bottom portion 13 by a carriage bolt 27 that passes through an aperture in bottom portion 13 and threads into a threaded aperture in bottom plate 33. Bottom plate 33 is made of an electromagnetic material. Bottom plate 33 has an aperture therein which accommodates a magnet 35 which is preferably in disk form. The magnet is preferably made out of neodymium magnetic material. A top plate 37 with a circular aperture 40 through its symmetrical center is fastened to the top of bottom plate 33. The circular aperture 40 exposes the magnet 35 within the bottom plate 33. The top plate 37 is fastened to the bottom plate 33 preferably by threaded screws and glue. A pole cap 39 is placed in the circular aperture of the top plate 37 on top of the magnet 35 within the bottom plate 33. The pole cap 39 has a diameter which leaves a space between its outside circumference and the inner circumference of the aperture 40 in top plate 37. This gap is sufficient to accommodate the voice coil wires 38 wound on voice coil form 41 at its second end. The voice coil has venting holes 44 along its first end. The voice coil wires 38 wound on coil form 41 are located within the circular aperture 40 of top plate 37.

The top portion 15 of the transducer housing has a circular aperture 46 (FIGS. 4 and 5) through its symmetrical center. This aperture allows for centering of the voice coil 41 during assembly by use of a centering gauge (not shown). The centering gauge is inserted in place to align the voice coil in the gap between the pole cap 39 and the circular aperture 40 in top plate 37. The first or upper end of voice coil 41 is glued to the inside surface 42 of the aperture 46 (FIG. 5) in the top portion 15 of the transducer housing. A spider 43 is glued to the mid-section of voice coil 41 and to top plate 37. When the adhesives have cured, the voice coil centering gauge is removed and the cap 17 is glued into the groove 16 of the top portion 15 of the transducer housing. A carriage bolt 45 extends through an aperture in cap 17 through a washer 47 on the other side and is fastened down by a hex nut 49. A flexible cover 51 slips over hex nut 49. A rubber boot 19 fits over the connected circumferential perimeter of the top and bottom portions of the housing to further seal out moisture and other impurities from the internal workings of the transducer.

Electrical connection to the sealed transducer is obtained by way of cable 23 which has a plug-in connector 25 at one end. The cable 23 passes through a cable grip mechanism 29 that is held to the metal bottom portion 13 of the transducer housing by a nut 21. The wires in cable 23 are connected to the wires 48 of the voice coil.

The carriage bolt 45 secured to the cap 17 provides the means for fastening the transducer to a surface to be driven. For example, the transducer can be attached to a flat surface by making a hole through the material and threading a ⅜" nut on the other end, thereby securely sandwiching the flat material between the nut and the transducer. If thicker material is to be driven by the transducer, a threaded insert may be embedded into the material so that the carriage bolt 45 can be threaded into it.

What is claimed is:

1. A transducer for converting electrical energy into mechanical energy, the transducer comprising: a top portion of a housing having a circumference and a height adapted to flex in a controlled manner; a bottom portion of a housing having a circumference and a depth adapted to be rigid and stationary with respect to the top and supporting the top portion along the circumferences of the top and bottom portions when the top and bottom portions are placed to define an enclosure; and a conductive coil positioned between the top and bottom portions of the housing, to receive electrical signals and cause elastic deflections of the top in response to currents in the conductive coil caused by the electrical signals, the conductive coil comprising a bottom plate with a recess capable of being physically attached to the bottom portion, inside the housing; a magnet adapted to fit within the recess of the bottom plate; a top plate with a circular aperture through a symmetrical center, the top plate capable of being attached to the bottom plate; a pole cap adapted to fit within the circular aperture in the top plate; and a voice coil having a first end and a second end, the voice coil having a diameter smaller than the circular aperture of the top plate, the voice coil adapted to oscillate with the second end in a space between the pole cap and the circular aperture of the top plate.

2. The transducer of claim 1 wherein the top portion has a six sided hexagonal shape with a flat top.

3. The transducer of claim 2 wherein the top portion has a circular aperture in the flat top.

4. The transducer of claim 2 further comprising a top cap that fits over the circular aperture in the top portion.

5. The transducer of claim 2 wherein the top portion has a ring in the flat top adapted to control the flexing of the top portion.

6. The transducer of claim 2 wherein the hexagonal shaped top portion has sides that are at an angle to the flat top.

7. The transducer of claim 6 wherein the sides of the hexagonal shaped top has a perpendicular section at each apex of the six side sections.

8. The transducer of claim 4 wherein the top cap is glued to the top portion.

9. The transducer of claim 8 wherein the top cap has a ridge which fits into a groove circumscribing the aperture in the top portion.

10. The transducer of claim 4 wherein the top cap has a bolt extending through the circumferential center of the top cap with its threaded shaft outward and fastened to the top cap.

11. The transducer of claim 4 wherein the top cap has a plurality of ridges radiating from the center.

12. The transducer of claim 1 wherein the bottom portion is circular and has a flat bottom.

13. The transducer of claim 12 wherein the bottom portion further comprises a plurality of fins attached to the flat bottom.

14. The transducer of claim 1 further comprising a spider attached to the voice coil and the top plate, for maintaining the voice coil aligned between the pole cap and the circular aperture of the top plate.

15. The transducer of claim 14 wherein the voice coil has apertures therein for dissipating heat generated by the conductive coil.

16. The transducer of claim 14 wherein said first end of the voice coil is capable of being attached to the top portion of the housing.

17. The transducer of claim 16 wherein the top portion of the housing has a circular apertures, and the first end of the voice coil is attached to the top portion of the housing at the circular aperture.

18. The transducer of claim 17 further comprising a cap that fits over the circular aperture in the top portion.

19. The transducer of claim 18 wherein the cap is glued to the top portion.

* * * * *